US007478613B2

(12) United States Patent
Gunnarsson et al.

(10) Patent No.: US 7,478,613 B2
(45) Date of Patent: Jan. 20, 2009

(54) ARRANGEMENT IN AIR-COOLED INTERNAL COMBUSTION ENGINE

(75) Inventors: Dan Gunnarsson, Norrhammar (SE); Goran Landen, Huskvarna (SE)

(73) Assignee: Husqvarna AB, Huskvarna (SE)

( * ) Notice: Subject to any disclaimer, the term of this patent is extended or adjusted under 35 U.S.C. 154(b) by 51 days.

(21) Appl. No.: 11/587,518

(22) PCT Filed: Apr. 22, 2005

(86) PCT No.: PCT/SE2005/000586

§ 371 (c)(1),
(2), (4) Date: Dec. 27, 2006

(87) PCT Pub. No.: WO2005/106235

PCT Pub. Date: Nov. 10, 2005

(65) Prior Publication Data

US 2007/0215090 A1 Sep. 20, 2007

(30) Foreign Application Priority Data

May 3, 2004 (SE) ..... 0401156

(51) Int. Cl.
*F01P 7/04* (2006.01)

(52) U.S. Cl. ..... 123/41.63; 123/198 E

(58) Field of Classification Search ..... 123/41.56, 123/41.63, 41.65, 198 E
See application file for complete search history.

(56) References Cited

U.S. PATENT DOCUMENTS

| | | | |
|---|---|---|---|
| 5,377,632 | A | 1/1995 | Aronsson et al. |
| 5,542,380 | A | 8/1996 | Chatten |
| 6,295,953 | B1 | 10/2001 | Oshawa et al. |

FOREIGN PATENT DOCUMENTS

| | | |
|---|---|---|
| DE | 19828728 | 12/1999 |

*Primary Examiner*—Noah Kamen
(74) *Attorney, Agent, or Firm*—Pearne & Gordon LLP

(57) ABSTRACT

Arrangement in an internal combustion engine, said arrangement comprises a fan for supplying combustion air to a carburetor. The fan comprises a fan housing (11) and a fan wheel (12) provided with a number of wings (13) extending in substantially radial direction from the axle (15) of rotation for the fan wheel (12). The arrangement further comprises an air inlet (14) for combustion air to the carburetor arranged at the outer edge of the wings (13) on the fan wheel (12). The outer edge of the wings (13) is arranged in a direction substantially parallel to the axle (15) of rotation for the fan wheel 10 (12). The side of the air inlet (14) closest to the outer edge of the wings (13) on the fan wheel (12) is arranged at an angle of 10° to 60° in relation to the outer edge of the wings (13) on the fan wheel (12) to reduce the amount of sound generated.

5 Claims, 1 Drawing Sheet

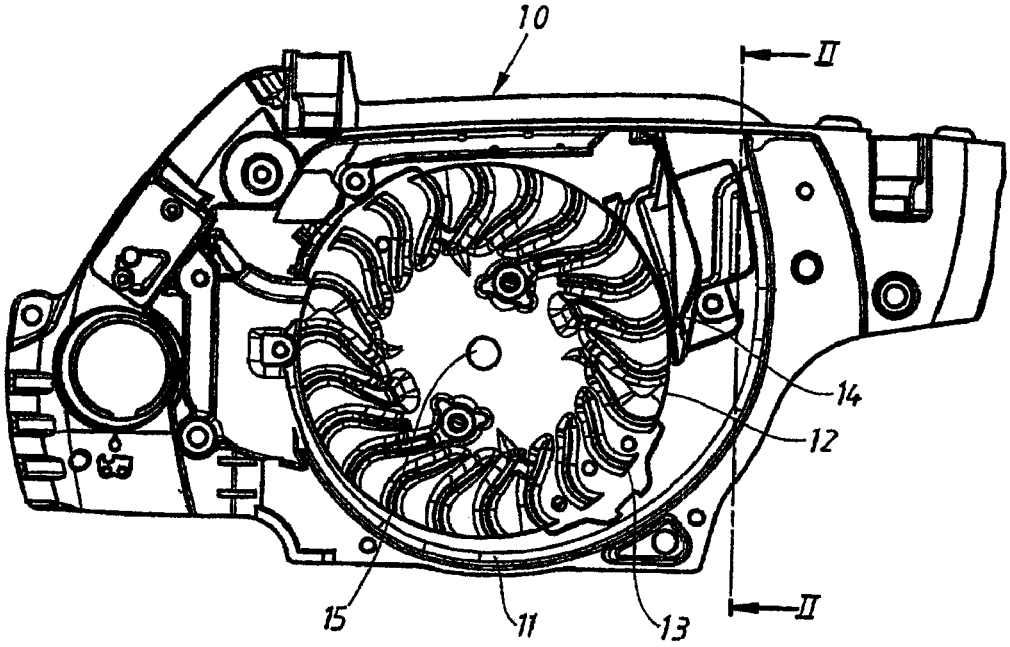
FIG. 1
FIG. 2
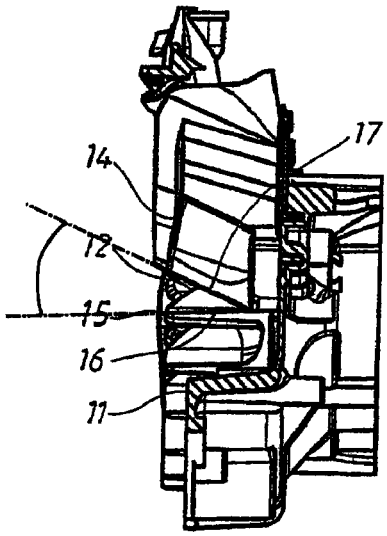

ARRANGEMENT IN AIR-COOLED INTERNAL COMBUSTION ENGINE

FIELD OF THE INVENTION

The claimed invention relates to an arrangement in an internal combustion engine.

DESCRIPTION OF RELATED ART

Small two-stroke internal combustion engines are used in handheld tools like for example chain saws and power cutters. Letting air from the surroundings pass through the tool is a frequently used solution to ensure that the heat generated during the combustion in the engine not will damage the engine, and to provide fresh air to the carburetor where it is mixed with fuel. The air and fuel mixture is then introduced in the combustion chamber in the cylinder.

In order to ensure a constant flow of cooling and combustion air through the tool the tool is provided with a fan comprising a fan housing and a fan wheel. The fan generates an airflow that is circulated inside the tool casing so that the heat-generating components are cooled. A part of the air stream from the fan wheel is entering an air inlet connected to the carburetor where the air is mixed with fuel.

The air surrounding these tools during use is however often polluted by saw dust, oil smoke, sand or snow raked up from the ground during work. The pollutions and particles in the air must therefore be removed from the air before the air is mixed with the fuel in the carburetor in order to reduce the wear on the engine. This is also important to ensure a reliable and efficient combustion of the fuel in the engine.

One arrangement reduces the amount of pollutions and particles in the combustion air is illustrated in U.S. Pat. No. 4,841,920. In this Patent document the combustion air is taken from a position close to the tip end of the wings on the rotating fan wheel. The air inlet is placed so that a plane through the inlet opening is extending in radial direction from the rotational axle of the fan wheel. The edge of the air inlet placed towards fan wheel is substantially parallel to the tip end of the wings and the axle of rotation for the fan wheel. This position of the air inlet is very favorable since this position ensures that the combustion air contains a small amount of pollutants and particles.

The arrangement illustrated U.S. Pat. No. 4,841,920 however suffers from the drawback that it generates a lot of sound which will have a negative influence on the working condition for the operator. The sound generated will have a frequency that is dependent of the number of rotations of the fan wheel and the number of wings on the fan wheel.

SUMMARY OF THE INVENTION

The invention characterized by the features in the independent claim reduces this problem.

The claimed arrangement for an internal combustion engine separates pollutions from the combustion air. The arrangement comprises a fan for supplying cooling air and combustion air to a carburetor, said fan includes a fan housing surrounding a fan wheel rotating around an axle in the centre of the wheel. The fan wheel is provided with a number of wings extending in substantially radial direction from the axle of rotation. The outer edges of the wings are substantially parallel to the axle of rotation for the fan wheel. Close to the outer edge of the wings in radial direction from the axle an air inlet for combustion air to the carburetor is arranged. The side of the air inlet positioned closest to the outer edge of the wings is arranged at an angle of 10° to 60° in relation to the outer edge of the wings, and consequently also substantially parallel to the axle of rotation.

This new arrangement reduces the sound generated in the fan considerably. This is achieved by arranging the side of the air inlet positioned closes to the outer edge of the wings at an angle of 10° to 60° in relation to the wing edges. This arrangement results in that only a small section of the outer edge of the wing will meet a small section of the angled side of the air inlet at a specific moment when the fan wheel is rotating. This is a big advantage compared to the solution described in U.S. Pat. No. 4,841,920 where the entire wing will meet the side of the air inlet at the same time. The claimed invention therefore reduces the amount of generated sound considerably.

One preferred embodiment of the claimed invention is to arrange the side of the air inlet at an angle so that the side will extend over at least two wings on the fan wheel. For most of the fan wheels in use for combustion engine powered tools would this embodiment mean that the angle between the side of the air inlet and the outer edge of the wings (parallel to the rotational axle) is 20° to 50°. This embodiment is very efficient for reducing the amount of generated sound from the fan and the air inlet.

The air inlet is placed as close to the outer edges of the wings as possible since the amount of pollutants is lower towards the outer edge of the wings. The air inlet must however be placed so that it never get in contact with the wing. The side of the air inlet is therefore placed at a distance of 1 to 10 millimeters from the edge of the wings.

BRIEF DESCRIPTION OF THE DRAWINGS

One embodiment of the claimed invention is illustrated in the drawings.

FIG. 1. Illustrates a side view of the claimed arrangement used in a chain saw.

FIG. 2. Illustrates a cross section through line A-A in FIG. 1.

DETAILED DESCRIPTION OF THE INVENTION

In FIG. 1 is a side view of the claimed arrangement used in a chain saw illustrated. Only a section 10 of the chain saw body is illustrated in the figure. A fan cover surrounding the claimed arrangement is not illustrated in the figure. The section 10 comprises a fan housing 11 and a fan wheel 12. The fan wheel 12 is rotating around an axle 15 and provided with a number of wings 13. The wings are S-shaped and extending in substantially radial direction on the fan wheel. Each wing 13 has an outer edge 16 substantially parallel to the axle 15 of rotation. The shape and number of the wings 13 are selected to meet the requirements for the specific use of the fan.

Close to the periphery of the fan wheel 12 an air inlet 14 is placed. The air inlet 14 is positioned so that the air inlet 14 will collect as much air as possible. A large amount of the generated air stream is rotating around the periphery of the fan wheel 12 in the fan housing 11. The air inlet 14 is therefore placed so that the air inlet 14 exposes a large area perpendicular to the direction of the air stream. The air inlet 14 comprises four substantially straight sides. The side 17 of the air inlet 14 placed closest to the outer edge 16 of the wings 13 is angled in relation to the outer edge 16 of the wings 13. The angle between the outer edge 16 of the wing 13 and the side 17 of the air inlet is between 10° to 60°. The side 17 closest to the outer edge 16 of the wing 13 is substantially parallel to the outer edge 16 of the wing 13 no matter of the angle of the outer edge

16 so that the small gap between the side 17 of the air inlet 13 and the outer edge 16 of the wing 13 has a substantially constant width.

The air inlet 14 is positioned somewhere around the fan wheel 12. The position of the air inlet 14 around the fan wheel 12 does not affects the final result of the invention.

What is claimed is:

1. Arrangement in an internal combustion engine, said arrangement comprising, an fan for supplying combustion air to a carburetor, said fan comprising a fan housing (11) and a fan wheel (12) provided with a number of wings (13) extending outwards from the axle (15) of rotation for the fan wheel (12), an air inlet (14) for combustion air to the carburetor arranged close to the outer edge (16) of the wings (13) on the fan wheel (12), said outer edge (16) of the wings (13) arranged in a direction substantially parallel to the axle (15) of rotation for the fan wheel (12), characterized in that the side (17) of the air inlet (14) closest to the outer edge (16) of the wings (13) on the fan wheel (12) is arranged at an angle of 10° to 60° in relation to the outer edge (16) of the wings (13) of the fan wheel (12) seen in axial direction of the fan wheel (12) to reduce the amount of sound generated.

2. Arrangement according to claim 1, characterized in that the angle between the outer edge (16) of the wings (13) on the side (17) of the air inlet (14) closes to the outer edge (16) of the wings (13) is 20° to 50°.

3. Arrangement according to claim 1 or 2, characterized in that the outer edge (16) of the wing (13) and the side (17) of the air inlet (14) is substantially straight.

4. Arrangement according to claim 1, characterized in that the side (17) of the air inlet (14) closest to the outer edge (16) of the wings (13) and the outer edge (16) is substantially parallel so that the gap between the outer edge (16) and the side (17) has a substantially constant width.

5. Arrangement according to claim 4, characterized in that the width of the gap is between 1 to 10 millimeters.

* * * * *